US009366017B2

(12) United States Patent
Cook

(10) Patent No.: US 9,366,017 B2
(45) Date of Patent: Jun. 14, 2016

(54) COMPRESSION DRAIN WITH ADJUSTABLE-HEIGHT GRATE

(71) Applicant: Joseph R. Cook, Parkland, FL (US)

(72) Inventor: Joseph R. Cook, Parkland, FL (US)

( * ) Notice: Subject to any disclaimer, the term of this patent is extended or adjusted under 35 U.S.C. 154(b) by 462 days.

(21) Appl. No.: 13/712,321

(22) Filed: Dec. 12, 2012

(65) Prior Publication Data

US 2014/0157514 A1 Jun. 12, 2014

(51) Int. Cl.
*E03C 1/12* (2006.01)
*E03F 5/04* (2006.01)

(52) U.S. Cl.
CPC ..... *E03F 5/0408* (2013.01); *E03F 2005/0413* (2013.01)

(58) Field of Classification Search
CPC ..... E03C 1/28
USPC ..... 4/679, 286, 288
See application file for complete search history.

(56) References Cited

U.S. PATENT DOCUMENTS

| | | | | |
|---|---|---|---|---|
| 3,742,525 | A * | 7/1973 | Oropallo | 4/288 |
| 3,744,065 | A | 7/1973 | Yavitch | |
| 3,896,511 | A * | 7/1975 | Cuschera | 4/288 |
| 4,067,072 | A | 1/1978 | Izzi | |
| 4,123,810 | A | 11/1978 | Oropallo | |
| 4,146,939 | A * | 4/1979 | Izzi | 4/286 |
| 4,261,824 | A * | 4/1981 | Cuschera | 210/164 |
| 4,694,513 | A | 9/1987 | Kiziah | |
| 8,112,827 | B2 | 2/2012 | DeGooyer et al. | |
| 8,347,424 | B2 * | 1/2013 | Wroblewski et al. | 4/288 |

* cited by examiner

*Primary Examiner* — Huyen Le
(74) *Attorney, Agent, or Firm* — Kevin P. Crosby; GrayRobinson, P.A.

(57) ABSTRACT

A compression drain for use with a preformed floor in which the height of the drain grate can be adjusted relative to said floor, and which positively locates the drain housing relative to the subfloor/waste water drain pipe. The arrangement provides a unitary, water tight, assembly that uses very little material to be manufactured, has very few moving parts, and is very easy to install.

2 Claims, 4 Drawing Sheets

COMPRESSION DRAIN WITH ADJUSTABLE-HEIGHT GRATE

CROSS-REFERENCE TO RELATED APPLICATIONS

N/A.

BACKGROUND OF THE INVENTION

1. Field of the Invention

This invention relates generally to drains, and, more particularly, relates to drains for showers, baths, sinks and other drainable surfaces which have height-adjustable drain tops associated therewith.

2. Background Art

There are many different types of drains for shower, bath, sink, basin and other installations in which a watertight fit is achieved. The drains usually employ a drain top or upper plate, sometimes known as a grate, which is either apertured or solid (i.e. through or around which water drains from the surrounding surface into the drain). For obvious reasons, it is desired that the drain top be substantially level with the adjacent surface, which may be comprised of the floor of the shower, bath, sink, basin or the like, or may be flooring material, such as tile applied thereover.

Due to the myriad possibilities of such arrangements, including thickness of the floor in which the drain is installed, and thickness of any flooring material adjacent the drain, it is necessary that the height of the drain top be adjustable relative to the remainder of the drain, thereby permitting adjustment of the position of the drain top relative to the surface surrounding the drain, so that the grate may be flush therewith.

Numerous height-adjustable drains have been proposed in the past, but none combine low cost with simple construction that positively delineate the position of the waste pipe relative to the drain, while simultaneously permitting the height of the drain top to be adjusted relative to the adjacent surface as well.

In addition, the process of shower, bath, basin, etc. installation has been vastly improved by the introduction of prefabricated modules used for forming the floor thereof. Use of these prefabricated modules significantly decreases the amount of time and skill required to construct a tile-covered assembly, as well as providing more of a consistent and reliable surface upon which to tile.

One type of such module is the prefabricated shower pan. These modules are pre-constructed molded units having a sloping floor, an integrated drain, and, if desired, curb(s) and sidewalls. Installation of the module involves applying adhesive and sealing material to the subfloor where the module will rest, and seating the module on the subfloor, while simultaneously securing a section of drain pipe to the drain. Tile can then be applied directly to the shower walls and module without the need for applying mortar to form a floor.

However, because the specifications for one job may call for the drain to be integrated into the shower module in a different location than it is for another job, different tools must be used to create two pans that might otherwise be nearly, or actually, identical.

It would be desirable, therefore, to be able to incorporate an adjustable top drain into a shower, bath, basin, etc. module in any location by simply creating a drain aperture in the floor of the module after it is manufactured, and fitting a drain into the floor with an adjustable drain top so that the drain top is coplanar with the adjacent surface or flooring material.

SUMMARY OF THE INVENTION

The present invention, in its preferred form, provides a compression drain for use with a preformed floor in which the height of the drain grate can be adjusted relative to said floor, and which positively locates the drain housing relative to the subfloor/waste water drain pipe. The arrangement provides a unitary, water tight, assembly that uses very little material to be manufactured, has very few moving parts, and is very easy to install.

DETAILED DESCRIPTION OF EXEMPLARY EMBODIMENT(S)

Figure 1:
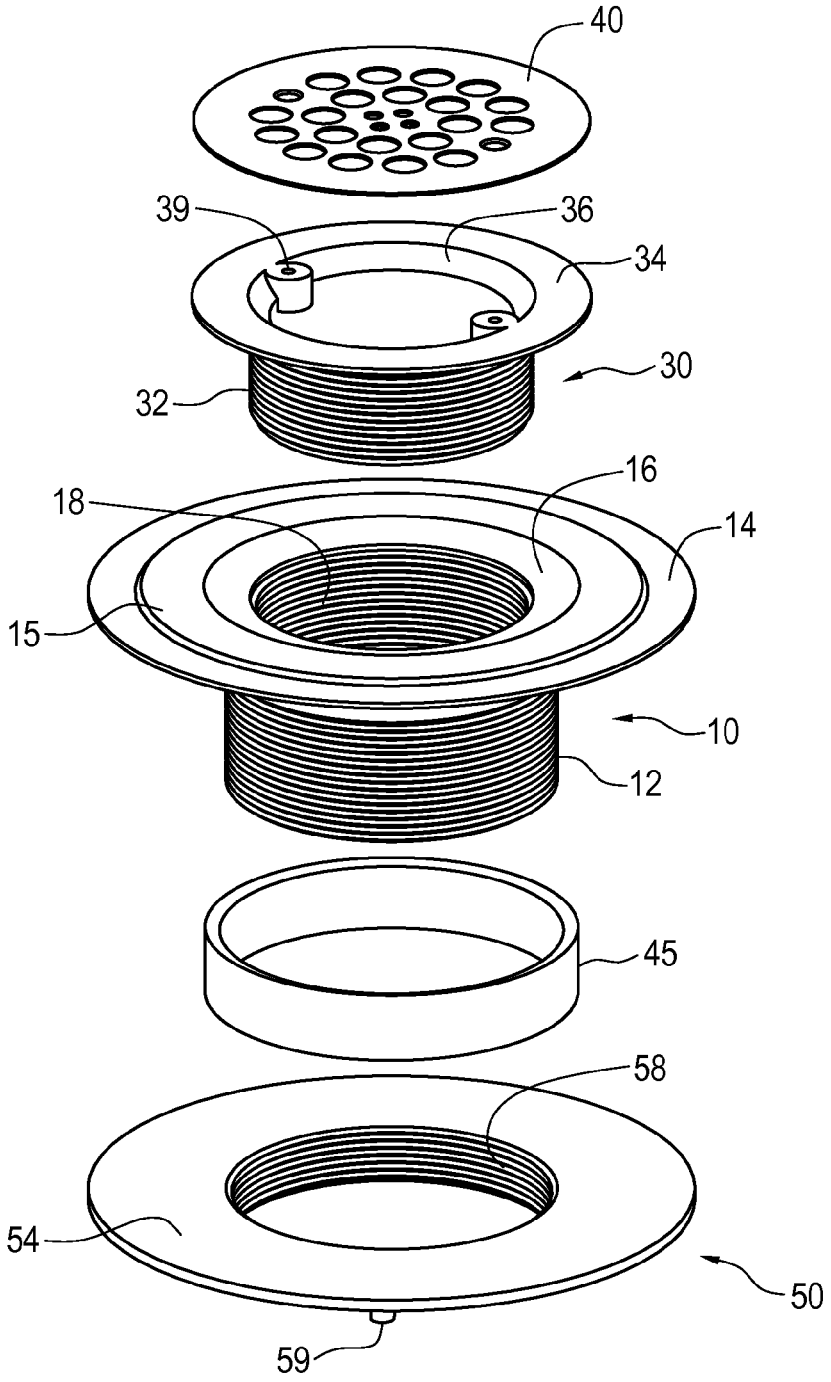
FIG. 1 is a top perspective exploded view of an embodiment of the invention.
Figure 2:
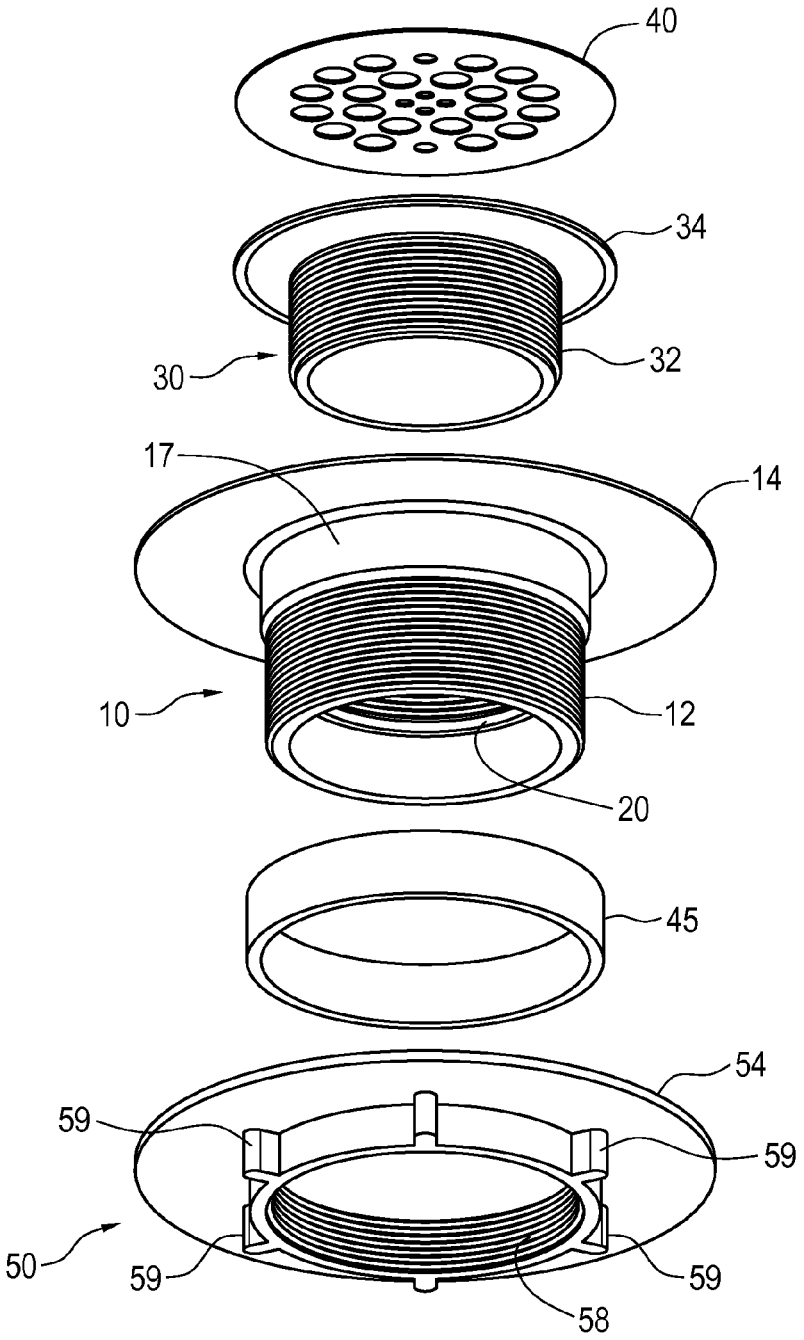
FIG. 2 is a bottom perspective exploded view thereof.
Figure 3:
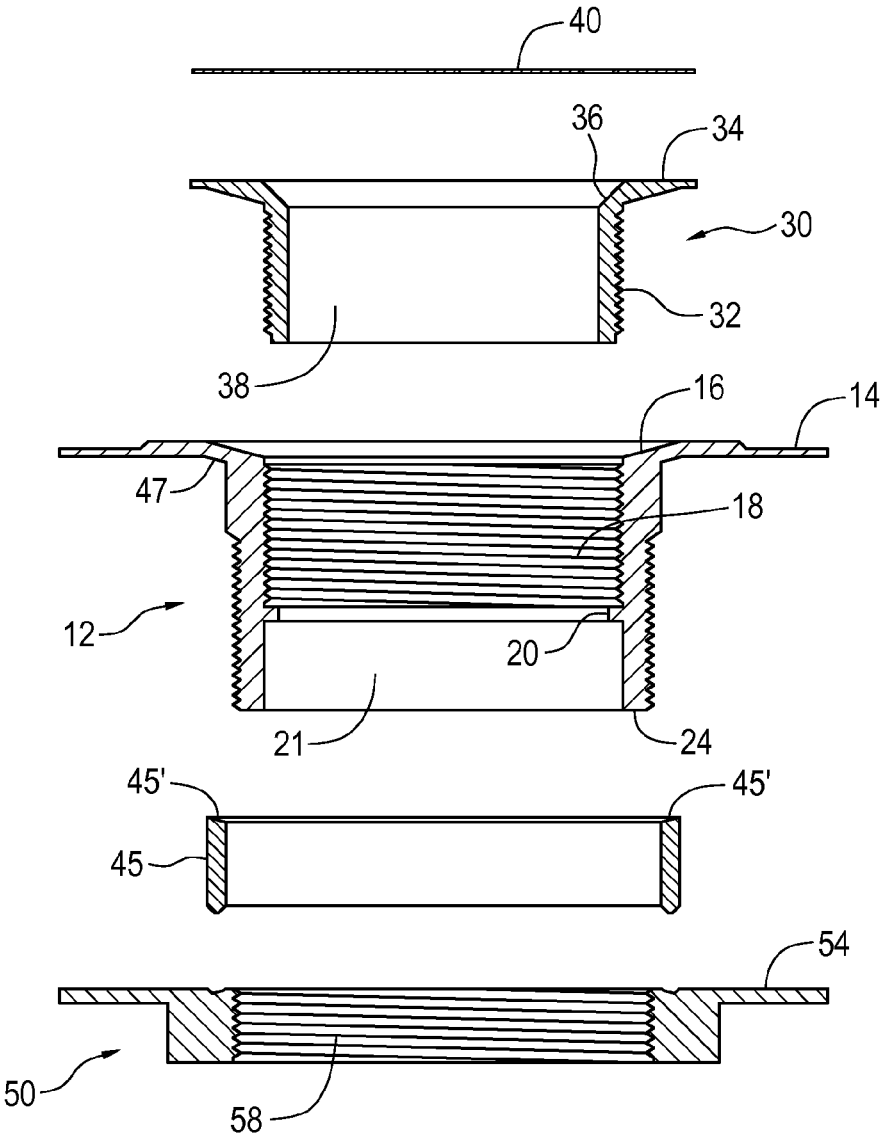
FIG. 3 is a front elevational cross-sectional exploded view thereof.

Before describing in detail exemplary embodiments that accord with the present invention, it should be observed that the embodiments reside primarily in combinations of apparatus components and processing steps related to implementing a compression drain for use with a preformed floor in which the height of the drain grate can be adjusted relative to said floor, and which positively locates the drain housing relative to the subfloor/waste water drain pipe. Accordingly, the apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms, such as "first" and "second," "top" and "bottom," and the like, may be used solely to distinguish one entity or element from another entity or element without necessarily requiring or implying any physical or logical relationship or order between such entities or elements. The terms "comprises," "comprising," or any other variation thereof are intended to cover a non-exclusive inclusion, such that a process, method, article, or apparatus that comprises a list of elements does not necessarily include only those elements, but may include other elements not expressly listed or inherent to such process, method, article or apparatus. The term "plurality of" as used in connection with any object or action means two or more of such objects or actions. A claim element proceeded by the article "a" or "an" does not, without more constraints, preclude the existence of additional identical elements in the process, method, article or apparatus that includes the element. The term "tile" also encompasses "stone" and/or "marble." The term "tiled" means any surface having tile, stone, and/or marble applied thereon. The term "sidewall," in relation to a shower module, means any vertical surface rising above the floor of the shower module along one or more peripheral edges and may be any height or any width, including, without limitation, an integrated curb. The term "shower enclosure space" refers to the volume defined by the framed-out walls, the area where the shower door or access area will reside, the bathroom sub-floor, and the ceiling.

FIGS. 1-4 illustrate the preferred form of the invention. It is to be understood, however, that this invention is not limited to the particular structures, process steps or materials disclosed herein, but is intended to encompass equivalents thereof as would be recognized by those of ordinary skill in the relevant arts. Therefore, it is to be understood that terminology used herein is employed for the purpose of describing particular disclosed examples of the invention only, and is not intended to limit the scope of the appended claims.

A drain in accordance with this invention is shown in FIGS. 1-4, wherein drain body 10 is comprised of a cylindrical, externally threaded, lower section 12 and an upper annular flange 14. Flange 14 may include a frustro-conically tapered section 16. A portion of the interior of lower section 12 consists of screw threads 18, and the remaining portion thereof comprises a shoulder 20 below screw threads 18 and a smooth cylindrical wall section 21 which is adapted to receive a waste pipe W emanating from subfloor S. Shoulder 20 acts as a stop against the upper end of waste pipe W so as to positively position drain body 10 relative to subfloor S.

Preferably, a drain of this invention is adapted to be used with a preformed shower pan floor or other surface, which may be formed integrally with, or assembled post-manufacture (e.g. in factory or in the field) as part of a waterproof pan, as known to those of skill in the art. Pan floor 35 defines, or is modified to include, an aperture 35' therein through which drain body 12 is adapted to be placed. A gasket 45, made out of any suitable material such as rubber, may be used to line the aperture 35' in pan floor 35, and be received about the exterior surface 17 of drain body 12. Preferably, the height of the gasket 45 corresponds substantially to the thickness of pan floor 35. A top edge 45' of gasket 45 may be chamfered so as to provide a nestable surface on which a correspondingly tapered lower surface 47 of flange 14 may sealingly mate.

Nut 50 is used to compress flange 14 of drain body 10 against an upper surface of pan floor 35, which may or may not define a corresponding annular recess within which flange 14 may nest. Flange 54 of nut 50 bears against a bottom surface of pan floor 35 to thereby compress drain body 10 in corresponding fashion against the top surface of pan floor 35. Lugs 59, or any other suitable structure, may be employed to engage a pipe wrench or other tool when tightening nut 50 to drain body 10.

A drain top 40, which may be of any type, including cylindrical, square or any other shape, apertured or not, is supported by drain top support 30. Drain top support 30 includes a lower cylindrical section 32 defining screw threads on at least a portion thereof adapted to mate with corresponding screw threads 18 in lower section 12. In this way, support 30 can be raised or lowered so as to adjust the height of drain top 40 relative to the top surface of pan floor 35 or any covering (e.g. flooring material) thereon. Drain top 40 may be connected to support 30 by any suitable means, such as screws received in threaded bosses 39 defined by support 30. A frustro-conically tapered section 36 may be employed adjacent upper flange 34 of support 30. Flange 34 may further define a recessed groove in which drain top 40 may fit.

Figure 4:
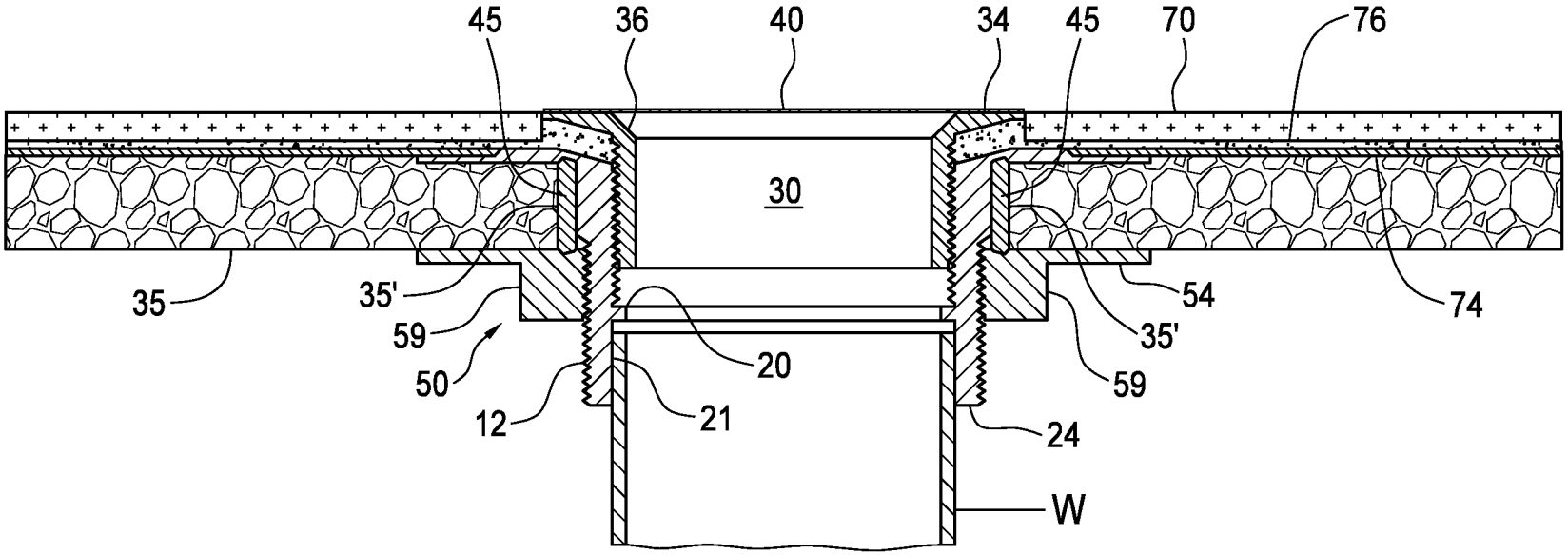
FIG. 4 is a front elevational cross-sectional assembled view thereof.

As best seen in FIG. 4, when assembled, the drain of this invention connects within aperture 35' in pan floor 35 by tightening nut 50 about the screw threads on lower section 12 of drain body 10 (and optional gasket 45 may also be utilized), where after support 30 is threaded to screw threads 18 of lower section 12 to a distance which renders the top surface of drain top 40 approximately coplanar with the surrounding surface, such as flooring tile 70. It is contemplated, however, that there will be installations where no flooring material is employed on pan floor 35 such that support 30 should be adjusted so as to position the top surface of drain top 40 substantially coplanar with the top surface of pan floor 35.

In the installation shown in FIG. 4, however, an insulated membrane such as rubber membrane 74 may be used, which membrane defines a central aperture which is concentric and coincides substantially with shoulder 15 of flange 14, said shoulder defined by a recessed groove in flange 14. In this way, the top surface of flange 14 radially inwardly from shoulder 15 is substantially coplanar with the top surface of the membrane 74. Thereafter, an adhesive material 76, such as an epoxy adhesive or other thin set mortar, is applied above membrane 74 and flange 14 and under the underside of flange 34 of support 30 to provide a seal thereafter, flooring material 70 such as flooring tile may be applied, and grouted if desired around the perimeter of drain top 40 and/or flange 34.

Flange 34 of support 30 may be formed to define a lower surface having a taper 34 relative to horizontal which is in part parallel with the frustro-conical recess 16 of drain body 12 when support 30 is threadingly engaged within threads 18 of drain body 12. In this way, a gap is created, as seen in FIG. 4, in which sealing material 76 such as epoxy adhesive can be inserted to provide a waterproof joint. Surfaces 34 and 16 need not be parallel to accomplish the desired result of defining a gap in which sealing material 76 may be placed.

The various components of the drain assemblies of this invention may be fabricated of any suitable material, such as metal, hardened resin, foam, or the like. In addition, drain top 40 may be made in any shape, the circular shape shown in the drawings being merely by way of example but not limitation. Drain top 40 may be apertured as shown, or may be solid, and mounted to support 30 in such a way as to provide a gap (not shown) between flange 34 and a bottom surface of drain top 40 through which water may drain. Drain top 40 may be adapted to receive tile or other flooring material thereon, or may be uncovered or partially covered.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made during the pendency of this application and all equivalents of those claims as issued.

The invention claimed is:

1. A drain for use in connection with a prefabricated shower pan floor, the floor defining a drain aperture, an upper surface and a lower surface, comprising:

a drain body comprising a cylindrical lower section and an annular flange formed as an upper section thereof, at least a portion of an outer surface of the lower section being threaded;

the lower section of the drain body defining a hollow interior bounded by a cylindrical interior wall, the wall defining:

an annular shoulder;

screw threads above the shoulder; and a smooth, waste water pipe receiving surface below the shoulder, such that an upper edge of the waste water pipe may contact a lower surface of the shoulder in abutting relation;

a gasket received about the outer surface of the drain body and lining the drain aperture, the gasket having a height that corresponds substantially to a thickness of the pan floor;

a nut having internal threads adapted to engage the screw threads on the exterior surface of the lower section of the drain body so as to compress a lower surface of the flange of the drain body against the upper surface of the pan floor, a top surface of the nut engaging a bottom surface of the gasket;

a drain top support comprising:

a lower cylindrical section defining screw threads on an exterior surface thereof adapted to engage the screw threads defined by the inner wall of the lower section of the drain body;

a drain top support flange connected to the lower section of the drain top support; and means for attaching the drain top to the support.

2. The drain of claim 1, wherein when the nut is engaged about the lower section of the drain body to thereby sandwich at least a portion of an upper surface of the nut and a lower surface of the drain body against lower and upper surfaces of the pan floor, respectively, and the support threadingly engaged at least partially within the drain body, wherein an upper surface of the drain top can be oriented substantially coplanar with flooring material connected to the upper surface of the pan floor.

* * * * *